United States Patent [19]

Schaffer et al.

[11] Patent Number: 4,932,461

[45] Date of Patent: Jun. 12, 1990

[54] COUNTERGRAVITY CASTING APPARATUS

[75] Inventors: Gregory A. Schaffer; James B. Mercer; Karl D. Voss; James Smith, Jr., all of Saginaw, Mich.

[73] Assignee: General Motors Corporation, Detroit, Mich.

[21] Appl. No.: 286,051

[22] Filed: Oct. 13, 1988

Related U.S. Application Data

[63] Continuation-in-part of Ser. No. 147,863, Jan. 25, 1988, abandoned.

[51] Int. Cl.[5] ..... B22D 18/06

[52] U.S. Cl. ..... 164/255; 164/339

[58] Field of Search ..... 164/255, 61, 63, 339, 164/342, 137, 341; 403/348, 349

[56] References Cited

U.S. PATENT DOCUMENTS

| | | | |
|---|---|---|---|
| 2,392,874 | 1/1946 | Pelaez | 292/36 |
| 2,915,762 | 12/1959 | Kivela | 403/348 |
| 3,675,499 | 7/1972 | Marosy | 403/348 |
| 3,692,353 | 9/1972 | Lynde | 292/36 |
| 4,616,691 | 10/1986 | Voss | 164/255 |
| 4,658,880 | 4/1987 | Voss | 164/255 |

*Primary Examiner*—Kuang Y. Lin

*Attorney, Agent, or Firm*—Lawrence B. Plant

[57] ABSTRACT

Apparatus for the vacuum, countergravity casting of metal in shell molds including a gas permeable shell mold secured to the mouth of a vacuum box by a plurality of keepers on the ends of rotatable shafts reciprocably slidable through the ceiling of the vacuum box, which keepers are adapted for insertion into and rotation within an anchoring cavity in the mold such that the keeper engages a portion of the mold overhanging the cavity to secure the mold to the box.

18 Claims, 5 Drawing Sheets

COUNTERGRAVITY CASTING APPARATUS

This invention relates to apparatus for the vacuum, countergravity casting of metal in gas-permeable, shell molds and, more particularly, to means for anchoring the mold to the vacuum chamber used therewith.

PRIOR APPLICATIONS

This is a continuation-in-part of U.S. patent application Ser. No. 147,863 filed on Jan. 25, 1988, in the names of G. A. Schaffer, J. B. Mercer and K. D. Voss, assigned to the assignee of this application, and abandoned as of the filing date of this application.

BACKGROUND OF THE INVENTION

The vacuum, countergravity, shell mold casting process is particularly useful in the making of thin-walled castings and involves: sealing a bottom-gated mold, having a gas-permeable upper portion, to the mouth of a vacuum chamber such that the chamber confronts the upper portion; immersing the underside of the mold in an underlying melt; and evacuating the chamber to draw melt up into the mold through one or more gates in the underside thereof. Such a process is shown in U.S. Pat. No. 4,340,108 wherein the mold comprises a resin-bonded-sand shell having an upper cope portion and a lower drag portion sealingly bonded together and attached to the vacuum chamber by means of spring clips which engage a peripheral abutment on the outside of the vacuum chambers. U.S. Pat. No. 4,340,108 seals the mold to the vacuum chamber atop the cope such that the parting line between the mold halves lies outside the vacuum chamber. U.S. Pat. No. 4,632,171 in the name of Roger almond and assigned to the assignee of the present invention, seals the mold to the vacuum chamber atop the drag such that the parting line between the cope and drag falls within the vacuum chamber. U.S. Pat. No. 4,632,171 uses spring biased bolts engaging the underside of the drag and extending along the outside of the vacuum chamber to secure the mold to the vacuum chamber. The heads of the bolts are immersed in the melt and accordingly have a very short useful life. G. D. Chandley, "Automatic Counter Gravity Casting of Shell Molds", Modern Casting, October 1983 pages 29–31, describes a technique for mounting round molds to a round vacuum chamber wherein the inside surface of the vacuum chamber includes self-tapping threads which screw into the periphery of the round mold. The latter technique has been restricted to relatively small molds and cannot be used with molds which are rectangular or have other than a round exterior. U.S. Pat. No. 4,658,880 describes the use of shafts having self-tapping threads on the ends thereof engaging the mold inside the vacuum chamber.

It is an object of the present invention to provide apparatus for the vacuum, countergravity casting of shell molds including improved means for quickly, simply, and reliably mounting the shell mold to the mouth of the vacuum box regardless of the shape or size of the mold and the vacuum chamber. This and other objects and advantages of the present invention will become more readily apparent from the detailed description thereof which follows.

BRIEF DESCRIPTION OF THE INVENTION

The invention comprehends an improved vacuum, countergravity casting apparatus including: a mold having a porous, gas-permeable upper shell and a bottom-gated lower portion secured to the upper shell; a vacuum box defining a chamber confronting the upper shell for evacuating the mold through the shell, which box comprises a peripheral wall having a lip on the underside thereof for sealingly engaging the mold and a ceiling overlying the mold; a plurality of anchoring cavities recessed in the mold, each of which is defined in part by at least one shelf-like, overhang portion(s) of the mold overlying the anchoring cavity; an opening in the mold contiguous the overhang providing access to the anchoring cavity; and anchoring means reciprocably slidable through the ceiling of the box, which anchoring means comprises (1) a plurality of shafts extending through the ceiling of the box, (2) a keeper on the lower end(s) of each shaft adapted for insertion through the opening(s) in the mold and into the cavity(s) and rotation therein to engage the underside(s) of the overhang portion(s), and (3) a means for rotating each shaft and keeper into engagement/disengagement with the underside of the overhang for mounting and demounting the mold to/from the vacuum box. The anchoring cavity is preferably defined by two overhang portions which flank the access opening to the cavity. The keeper is preferably an elongated bar welded or otherwise secured to the lower end of the shaft midway on the bar so that upon 90° rotation of the shaft one half of the bar engages the underside of one of the overhangs and the other half of the bar engages the underside of the other overhang. All the shafts will preferably be appropriately mechanically linked or pneumatically/hydraulically coupled together for simultaneous/en masse rotation.

The invention may better be understood when considered in the light of the following detailed description of certain specific embodiments thereof which is given hereafter in conjunction with the several drawings.

DETAILED DESCRIPTION OF SPECIFIC EMBODIMENTS

Figure 1:
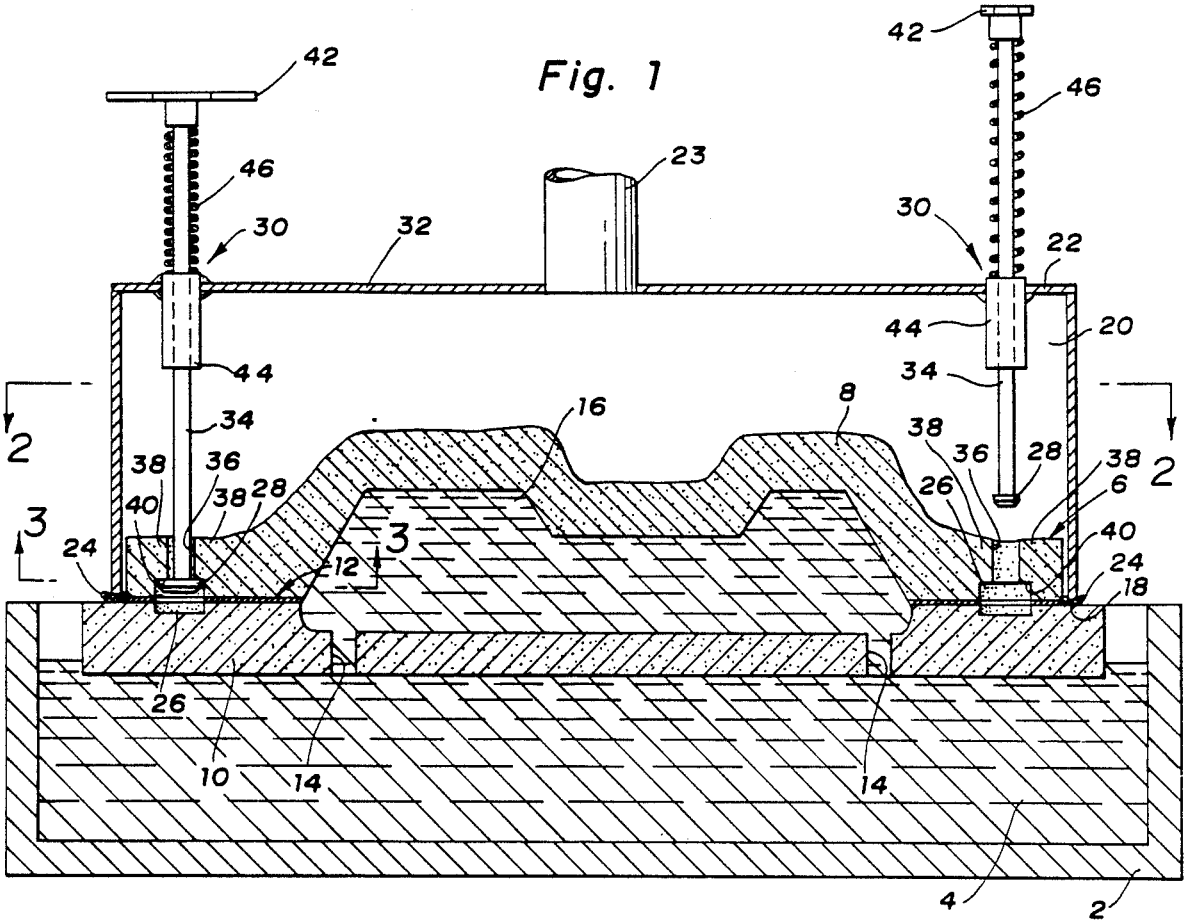
FIGS. 1, 4 and 6 are partially sectioned front or side (i.e., FIG. 4) elevational views through different embodiments of vacuum, countergravity metal casting apparatus in accordance with the present invention.

In the drawings, like reference numerals are used for like parts in all of the Figures. The several Figures show a pot 2 of metal melt 4 which is to be drawn up into the mold 6. The mold 6 includes a gas-permeable, upper portion 8 secured (e.g., glued) to a lower portion 10 along parting line 12 and a molding cavity 16 therebetween. The lower portion 10 includes a plurality of ingates 14 on the underside thereof for supplying melt to the mold cavity 16 when the cavity is evacuated. The lower portion 10 of the mold 6 is sealed (i.e., via a high temperature gasket material 24) to the mouth 18 of a vacuum chamber 20 which is defined by vacuum box 22 such that the gas-permeable upper portion 8 is confronted by the chamber 20. The vacuum chamber 20 communicates with a vacuum source (not shown) via conduit 23. The upper (i.e., cope) portion 8 of the mold 6 comprises a gas-permeable material (e.g., resin-bonded-sand, ceramic, etc.) which permits gases to be withdrawn from the casting cavity 16 when a vacuum is drawn in the chamber 20. The lower portion 10 of the mold 6 may conveniently comprise the same material as the upper portion 8, or other materials, permeable or impermeable, which are compatible with the upper portion material.

Figure 2:
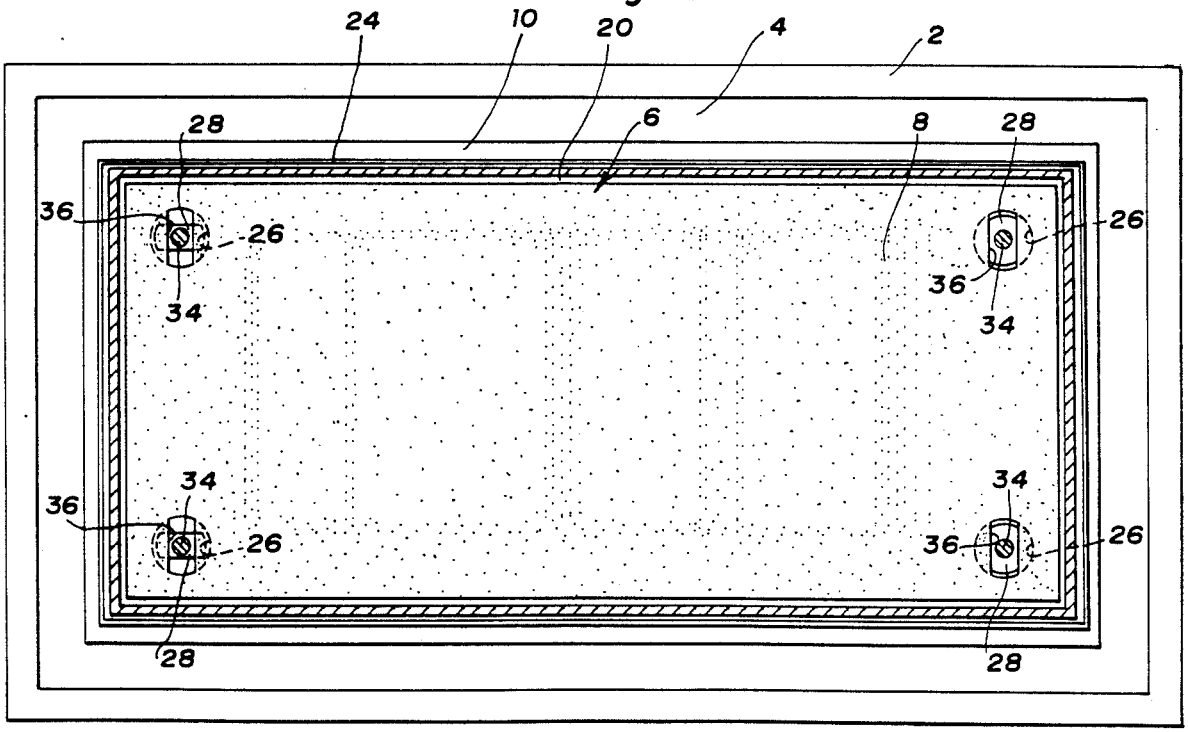
FIG. 2 is a top view taken in the direction 2—2 of FIG. 1.
Figure 3:
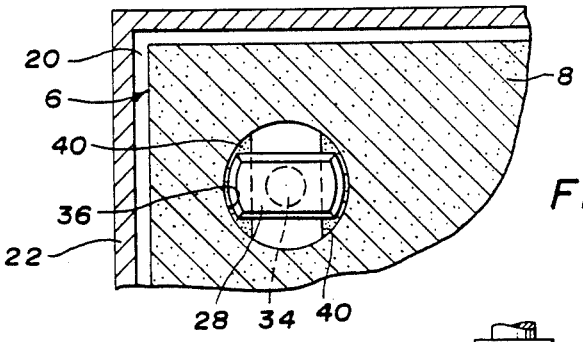
FIG. 3 is an enlarged bottom view in the direction 3—3 of FIG. 1.

In accordance with one embodiment of the present invention (see FIGS. 1–3), a plurality of anchoring cavities 26 are provided in the mold 6 and are adapted to receive keepers 28 on the ends of the anchoring means 30 (i.e., one at each corner of the mold 6) which extend through the ceiling 32 of the vacuum box 22. More specifically, each of the anchoring means 30 comprises an axially and rotatably movable shaft 34 having an elongated keeper bar 28 secured at about its center onto the lower end of the shaft 34. The keeper bar 24 passes through an elongated, substantially complementary shaped, access opening 36 to the cavity 26 in the mold 6. The opening 36 is flanked on both sides by portions 38 of the mold 6 which overhang and partially define the cavity 26. After insertion into the cavities 26, the keeper bars 28 are rotated under the overhang portions 38 to engage the underside 40 of the overhang portions 38. Alternatively, a single overhang and a keeper comprising a half-bar, as it were secured at its end to the shaft 34 may also be used to engage a single overhang portion. However, the full bar keeper and dual overhang shown is preferred for providing the most reliable anchoring.

In the embodiment shown in FIG. 1, the several anchoring means 30 are each manually operated so as to mate with the several anchoring cavities 26 one at a time. To this end, a handle 42 is provided on the end of the shaft 34 opposite the keeper 28. The shaft 34 slides through an elongated bushing 44 welded to the ceiling 32 of the box 22 which serves not only to keep the shaft registered with the openings 36 but also to prevent any significant loss of vacuum from the chamber 20 along the shaft 34. Compression springs 46 are provided between the bushing 44 and the handle 42 to bias the mold 6 tightly against the mouth 18 of the box 22 after the keepers 28 have been inserted through the opening 36 into the cavity 2 and rotated under the overhanging ledges 38. In FIG. 1, the anchoring means 30 on the left side of the drawing is shown in the anchoring position engaging the overhang portions 38 while on the right side of the drawing, the anchoring means 30 is shown positioned above the opening 36 prior to insertion therein.

In accordance with the most preferred embodiment of the invention (see FIGS. 4 and 5), the several anchoring means 30 are all mechanically linked together by linkage means 50 adapted to engage/disengage the several keepers with/from the mold en masse. More specifically, linkage means 50 includes a frame comprising support members 52 secured to and carried by a tubular steel cross member 54 via brackets 56. An air cylinder 58 is detachably secured (e.g., bolted) to the center of the cross member 54 via a mounting bar 60 to raise and lower the linkage means 50 as required to engage/disengage the keepers 28 from the mold 6. The shafts 34 are axially s rIN A1A1 p0p adjustably, to the upper ends 70 of the shafts 34 and lower arms 72 which may be threaded onto the threads 74 on the shaft 34. Compression springs 76 bias the yoke 66 upwardly relative to the supports 52 to hold the mold firmly, yet resiliently, in place in the chamber 20. Bushings 102 secured to the top of the box 22 permit the shafts 34 to slide axially therethrough as well as rotate therein without substantially reducing the vacuum in the chamber 20.

When the mold 6 is to be secured in chamber 20, the air cylinder 58 is energized to extend the rod 59 so as to move the support members 52 downwardly which in turn push on the lower arms 72 of the yoke 66. This causes the shafts 34 to slide axially in the bushings 102 to insert the keepers 28 in the openings 36 above the cavities 26. Toggles 90 and 92 and lever arms 98 and 100 are rigidly secured to the bushings 62 so as to effect rotation thereof when the toggles 90, 92 are moved. Thereafter, an air cylinder 80, which is rigidly anchored to the cross member 54 via support arm 82, is energized to retract the cylinder rod 84. As the rod 84 moves to the left (see FIG. 5), link 86 which is attached thereto at joint 88 also moves to the left and causes the toggles 90 and 92 to rotate clockwise 90°. At the same time, shorter links 94 and 96, which are rotatably coupled to the toggles 90 and 92, act on lever arms 98 and 100 to also rotate them 90°. Once the keepers 28 have been rotated into anchoring positions, air cylinders 58 is retracted causing the anchoring means 30 to firmly, but resiliently (i.e., against the springs 76), hold the mold 6 in place in the chamber 20.

Figure 6:
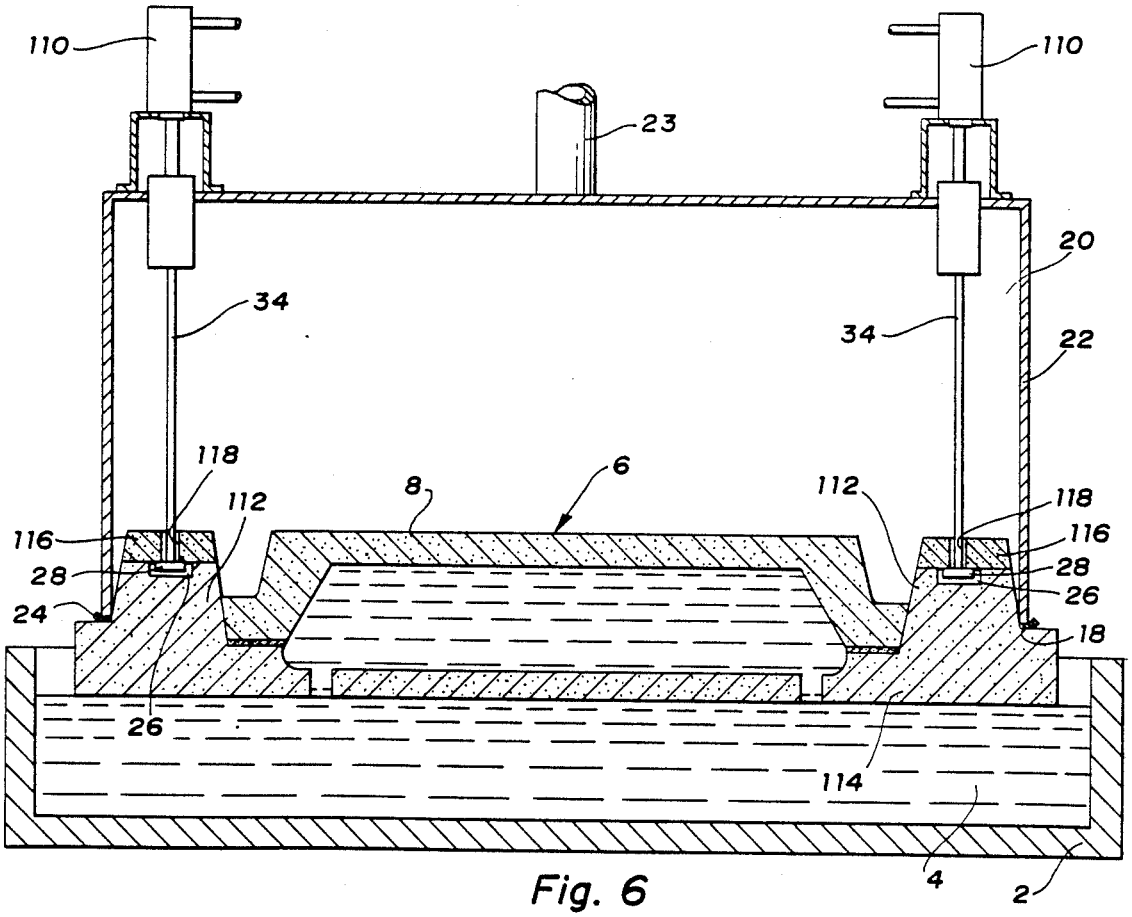

FIG. 6 depicts still another embodiment of the present invention wherein individual air motors 110 on the upper ends of each of the shafts 34 are actuated substantially simultaneously from a common air source (not shown) to both insert the keepers 28 in the anchoring cavities 26 as well as rotate them therein for anchoring the mold in the chamber 20. In this embodiment and unlike FIG. 1, the keepers 28 engage cavities 26 formed in upstanding portions 112 formed on the drag portion 114 of the mold 6. Caps 116 having keeper-receiving openings 118 therein are glued or otherwise secured atop the upstanding portions 112 to provide the requisite cavity overhanging portions needed to engage the keepers 28.

Figure 7:
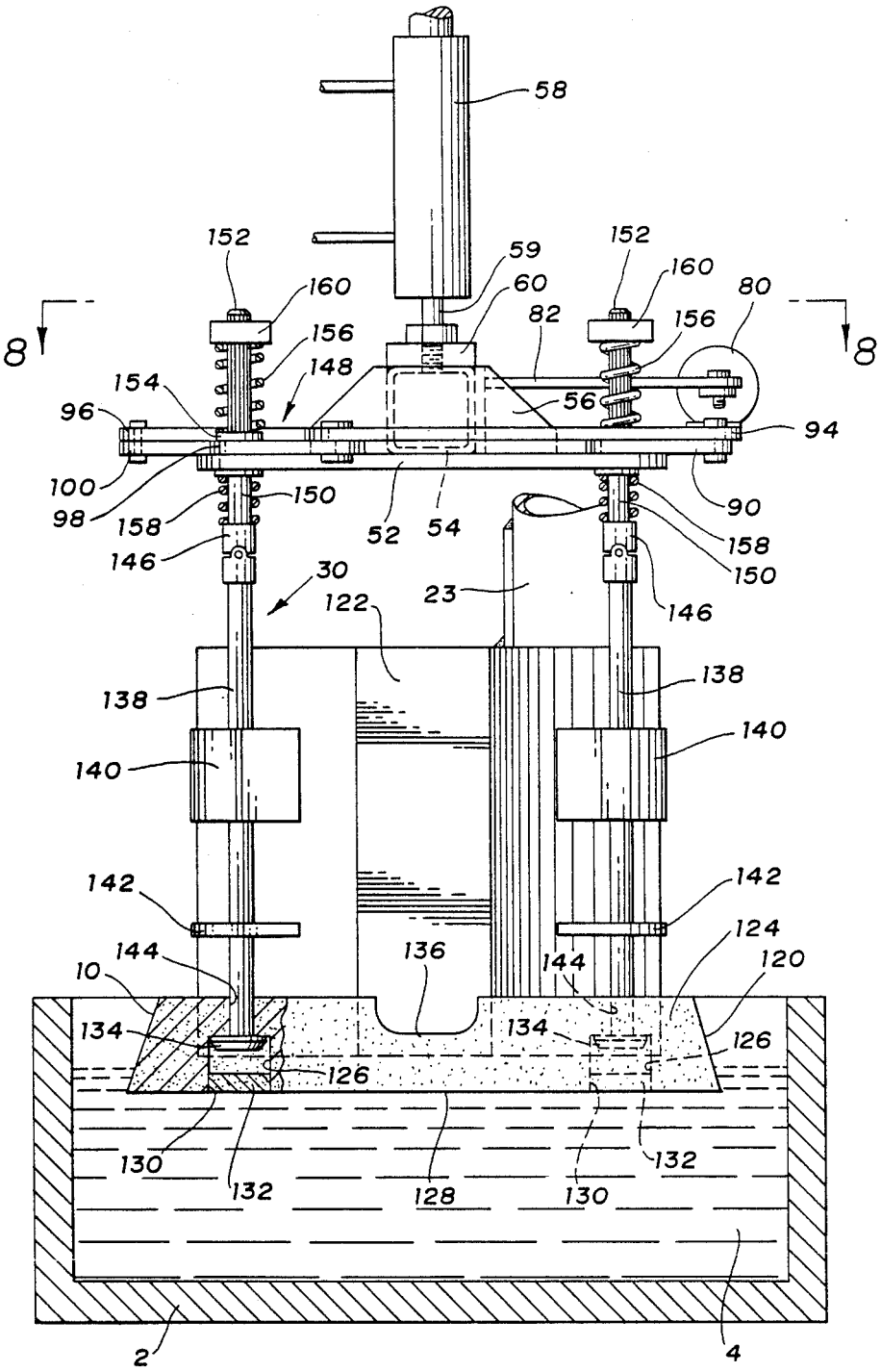
FIG. 7 is a partially sectioned elevational view of another embodiment of the present invention.
Figure 8:
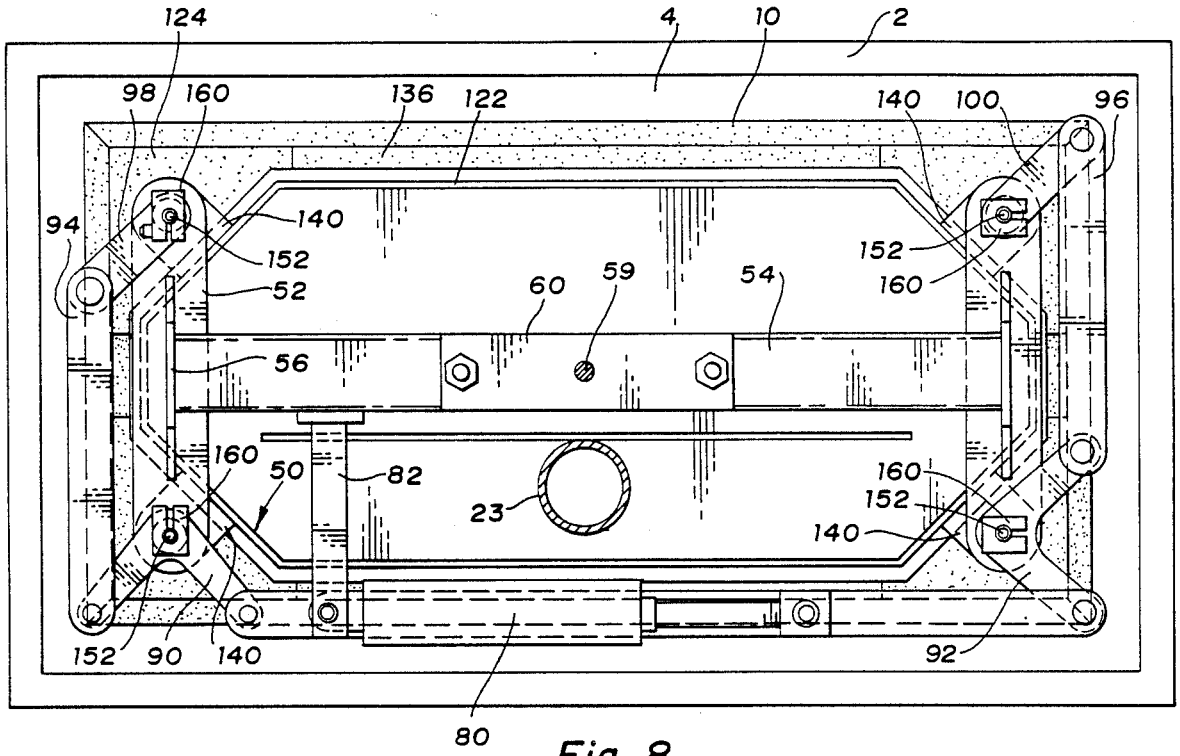
FIG. 8 is a top view in the direction 8—8 of FIG. 7.

FIGS. 7 and 8 depict another embodiment of the present invention wherein the means for anchoring the mold to the vacuum chamber lie on the outside of (i.e., outboard) the chamber, the anchoring cavities are formed from the underside of the bottom portion of the mold and the mouth of the anchoring cavity (i.e., where it opens to the underside of the mold) is plugged with mold material or the like to protect the keeper from the deleterious effects of the melt when the mold is immersed therein. More specifically, the Figures show the lower portion 120 of the mold secured to an octagonal vacuum chamber 122 and immersed in the melt 4 in the pot 2. The lower portion 120 includes four towers 124 extending upwardly from the corners of the mold for housing the anchoring cavities 126 which are formed in the towers 124 from the underside 128 of the lower mold portion 120. Forming the cavities from the underside of the mold simplifies the cavity forming process and particularly eliminates the need for a separate cap such as #116 in FIG. 6. The mouth 130 of the cavity 126 where it opens to the underside of the mold 128 is preferably closed off with a plug of mold material 132 to protect the keeper 134 from contacting the melt 4. An upstanding levee 136 circumscribes the junction between the chamber 122 and the lower portion 120 of the mold to protect the junction from the melt as described and claimed in U.S. patent Mercer et al 4,745,962 assigned to the assignee of the present invention.

Figure 9:
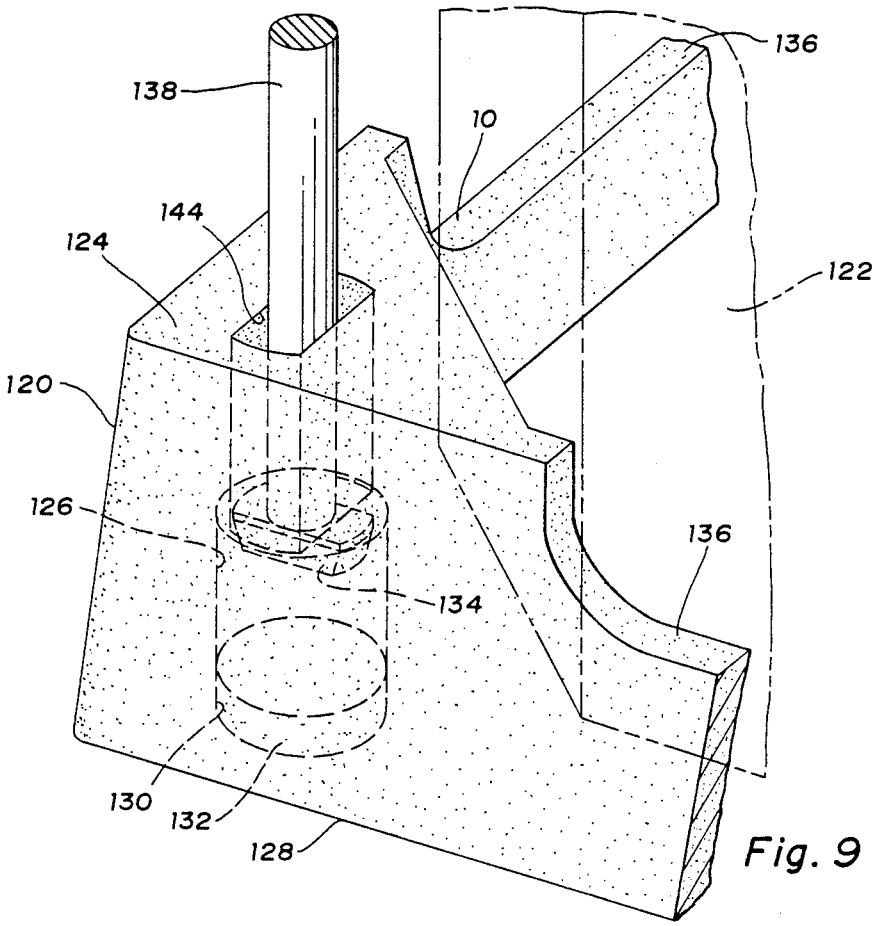
FIG. 9 is an enlarged perspective view of one corner of the apparatus of FIG. 7.

In the embodiment shown in FIGS. 7–9, the anchoring means 30 is adapted to engage the bottom portion 120 of the mold on the outside of the vacuum chamber 122. More specifically, shafts 138 of the anchoring means 30 reciprocate and rotate in ball bushings 140 and guide rings 142 which stabilize and guide the shaft 138 and keepers 134 into the opening 144 to the cavity 130. Flexible couplings (e.g., U-joint) 146 on the upper ends of the shafts 138 allow for any misalignment between the shafts 138 and the actuating means 148 and thereby serves to prevent binding of the shafts in the bushings 140 and/or guide rings 142. Rods 150 extend from the other end of each coupling 146 into engagement with the actuating means 148. External splines 152 engage internal splines in the bushings 154 to allow axial movement of the rods 152 yet still permit rotation thereof when the bushings 154 are rotated. Upper springs 156 and lower springs 158 function as shock absorbers and permit resilient engagement of the mold by the keepers 134 and thereby prevent such damage to the molds as might otherwise occur were the system's components too rigid and incapable of adjusting to variations in the mold etc. Locking collars 160 are movable up or down along the rods 150 to adjust the position of the keepers 134 and the degree of compression on the springs 156 and 158.

Figure 4:
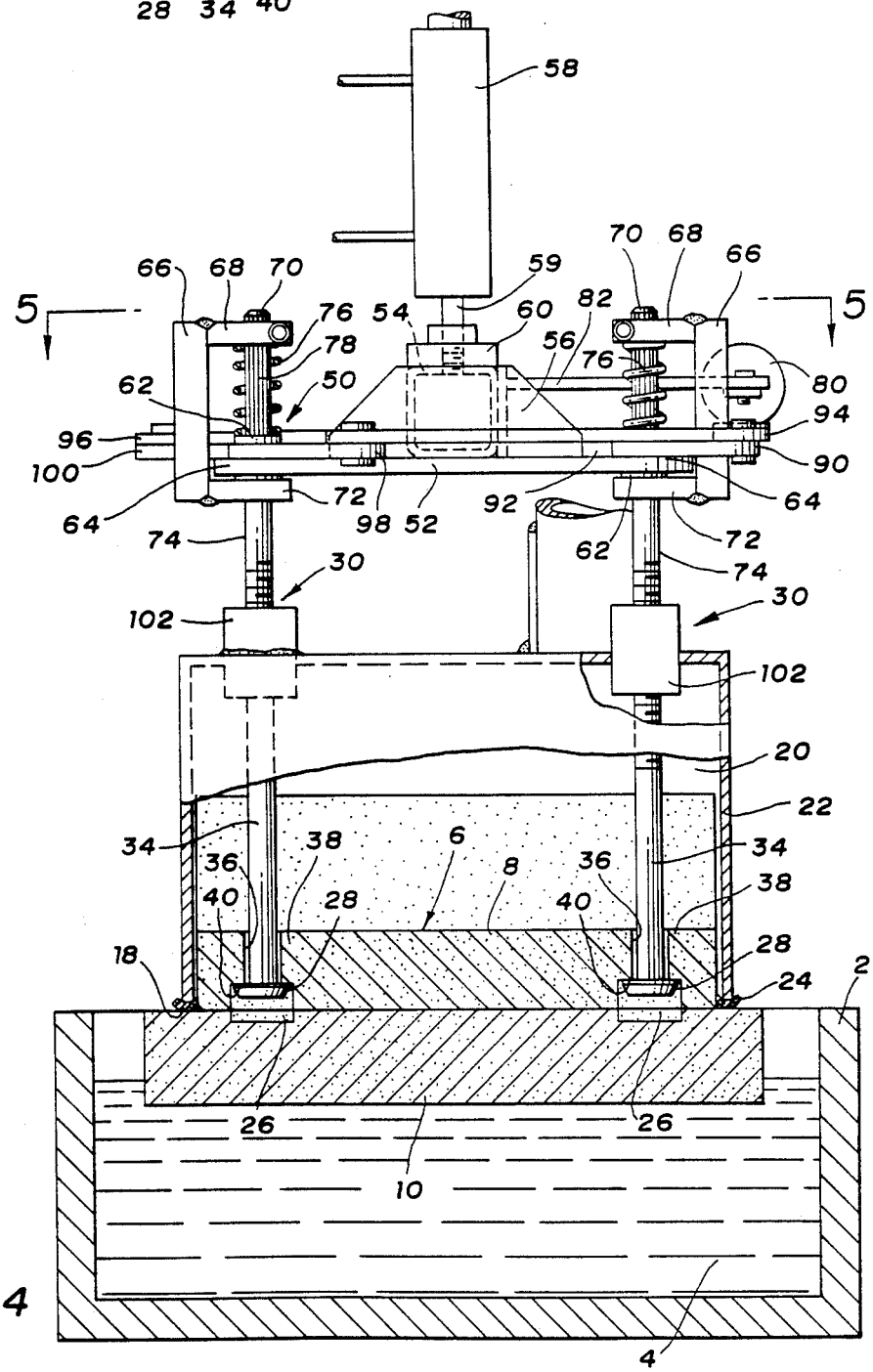
Figure 5:
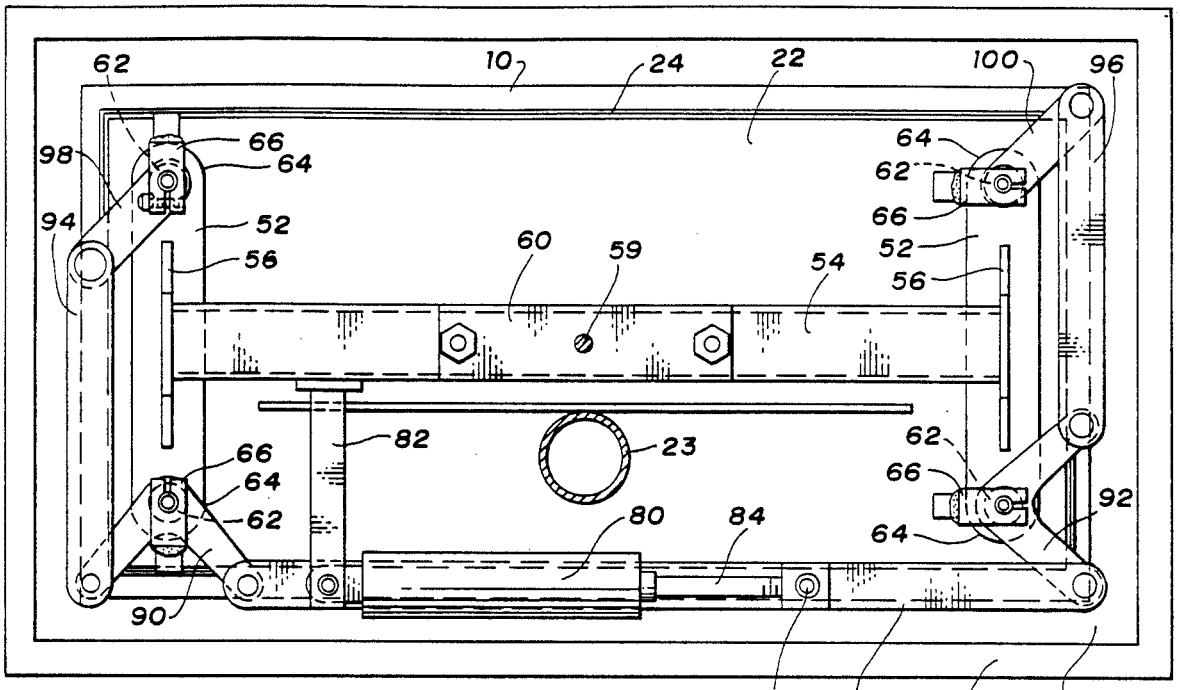
FIG. 5 is a top view in the direction 5—5 of FIG. 4.

The mechanism for simultaneously actuating the anchoring means 30 in FIGS. 7–9 is essentially the same as shown in FIGS. 4 and 5 in that toggles 90 and 92, lever arms 98 and 100 and links 94 and 96 therebetween move together to rotate the shafts 138 to engage and disengage the mold in the same manner as described above when the mechanism is lowered onto the mold by air cylinder 58 and the air cylinder 80 is actuated.

While the invention has been described primarily in terms of specific embodiments thereof it is not intended to be limited thereto but rather only to the extent set forth hereafter in the claims which follows.

The embodiments of the invention in which an exclusive property or privilege is claimed are defined as follows:

1. Apparatus for the vacuum countergravity casting of molten metal comprising:

a mold comprising a porous gas-permeable upper shell at least in part defining a molding cavity, and a bottom-gated lower portion secured to said upper shell for admitting said metal into said cavity from an underlying pot of said metal and said mold;

a plurality of anchoring cavities recessed in said mold, said cavities each being defined in part by at least one overhang portion of said mold overlying said cavity;

a plurality of preformed openings in said mold said openings each being contiguous a said overhang portion and providing access to said cavity;

a vacuum box sealingly engaging said mold and defining therewith a vacuum chamber confronting said upper shell for evacuating said cavity through said shell, said box having a ceiling overlying said mold;

means reciprocally slidable through said ceiling for engaging said mold so as to anchor said mold in said chamber, said means comprising a plurality of shafts extending through said ceiling in registry with said openings and a keeper on the lower end of each of said shafts adapted for insertion into a said cavity through said opening and rotation therein to engage the underside of said overhang portion; and rotator means operatively associated with each said shaft for rotating said keeper into engagement/disengagement with said underside to respectively mount/dismount said mold to/from said box.

2. Apparatus for the vacuum countergravity casting of molten metal comprising:

a mold comprising a porous gas-permeable upper shell at least in part defining a molding cavity, and a bottom-gated lower portion secured to said upper shell for admitting said metal into said cavity from an underlying pot of said metal and said mold;

a plurality of preformed anchoring cavities recessed in said mold, said cavities each being defined in part by at least one overhang portion of said mold overlying said cavity;

a plurality of openings in said mold said openings each being contiguous a said overhang portion and providing access to said cavity;

a vacuum box sealingly engaging said mold and defining therewith a vacuum chamber confronting said upper shell for evacuating said cavity through said shell, said box having a ceiling overlying said mold;

guide means engaging said vacuum box, for guiding anchoring means through said opening;

anchoring means reciprocally slidable through said guide means for engaging said mold so as to anchor said mold in said chamber, said anchoring means comprising a plurality of shafts extending through said guide means in registry with said openings and a keeper on the lower end of each of said shafts adapted for insertion into a said cavity through said opening and rotation therein to engage the underside of said overhang portion; and rotator means operatively associated with each said shaft for rotating said keeper into engagement/disengagement with said underside to respectively mount/dismount said mold to/from said box.

3. Apparatus according to claim 1 wherein said cavity is defined by at least two overhang portions of said mold, said opening is flanked by said portions, and said keeper is an elongated bar secured to said shaft so as to engage the undersides of both said overhang portions upon rotation of said keeper to mount said mold to said box.

4. Apparatus according to claim 1 including means for substantially simultaneously rotating said shafts.

5. Apparatus according to claim 4 wherein said rotator means comprises mechanical linkage overlying said box including toggle means for effecting said rotation and a plurality of links coupling said toggle means together and to a motor for engaging/disengaging said keepers en masse.

6. Apparatus according to claim 1 including spring means biasing said shafts upwardly with sufficient force to support and secure said mold to said box without breaking away said overhang portion.

7. Apparatus according to claim 4 wherein said means comprises individual fluid motors atop each shaft.

8. Apparatus for the vacuum countergravity casting of molten metal comprising:

a mold comprising a porous gas-permeable upper shell at least in part defining a molding cavity, and a bottom-gated lower portion secured to said upper shell for admitting said metal into said cavity from an underlying pot of said metal and said mold;

a plurality of preformed anchoring cavities recessed in regions of said lower portion lying outboard said shell, said cavities each being defined in part by at least one overhang portion of said mold overlying said cavity;

a plurality of openings in said mold said openings each being contiguous a said overhang portion and providing access to said cavity;

a vacuum box sealingly engaging said mold inboard said cavities and defining therewith a vacuum chamber confronting said upper shell for evacuating said cavity through said shell, said box having a ceiling overlying said mold;

guide means extending outboard said vacuum box for guiding anchoring means through said openings;

anchoring means reciprocally slidable through said guide means for engaging said mold so as to anchor said mold in said chamber, said anchoring means comprising a plurality of shafts extending through said guide means in registry with said openings and a keeper on the lower end of each of said shafts adapted for insertion into a said cavity through said opening and rotation therein to engage the underside of said overhang portion; and rotator means operatively associated with each said shaft for rotating said keeper into engagement/disengagement with said underside to respectively mount/dismount said mold to/from said box.

9. Apparatus according to claim 8 wherein said cavity is defined by at least two overhang portions of said mold, said opening is flanked by said portions, and said keeper is an elongated bar secured to said shaft so as to engage the undersides of both said overhang portions upon rotation of said keeper to mount said mold to said box.

10. Apparatus according to claim 8 including means for substantially simultaneously rotating said shafts.

11. Apparatus according to claim 10 wherein said simultaneous rotating means comprises mechanical linkage overlying said box including toggle means for effecting said rotation and a plurality of links coupling said toggle means together and to a motor for engaging/disengaging said keepers en masse.

12. Apparatus according to claim 8 including spring means biasing said shafts upwardly with sufficient force to support and secure said mold to said box without breaking away said overhang portion.

13. Apparatus according to claim 8 including a flexible coupling on said shaft intermediate said rotator means and said keeper for preventing said shaft from binding in said guide means.

14. Apparatus according to claim 8 wherein each said cavity has a mouth opening to the underside of said lower portion.

15. Apparatus according to claim 8 wherein upstanding levee means joins said region one to the other so as to circumscribe the mouth of said chamber where it sealingly engages said mold and protects it from melt during immersion in the melt.

16. Apparatus according to claim 15 wherein a plug fills said mouth to shield said keeper from melt during filling of the mold.

17. Apparatus according to claim 8 wherein said anchoring cavities reside in a plurality of towers extending upwardly from said lower portion.

18. Apparatus according to claim 15 wherein said regions comprise towers extending upwardly from said lower portion.

* * * * *